US005894705A

United States Patent [19]

Sutton

[11] Patent Number: 5,894,705

[45] Date of Patent: Apr. 20, 1999

[54] FLOOR INSTALLATION CLAMP

[76] Inventor: Joel Sutton, 14119 SE. 12th St., Vancouver, Wash. 98683

[21] Appl. No.: 08/702,361

[22] Filed: Aug. 21, 1996

[51] Int. Cl.[6] ..... E04F 21/22

[52] U.S. Cl. ..... 52/747.1; 52/749.1; 52/DIG. 1; 254/17; 254/11; 269/21; 269/904; 248/362; 248/363

[58] Field of Search ..... 52/747.1, 749.1, 52/DIG. 1; 254/17, 11, 12, 13, 14, 15, 16; 269/21, 43, 66, 904, 909; 294/64.1; 248/362, 363

[56] References Cited

U.S. PATENT DOCUMENTS

| | | | |
|---|---|---|---|
| 796,968 | 8/1905 | Herr . | |
| 1,313,307 | 8/1919 | Locraft | 248/362 X |
| 2,212,755 | 8/1940 | Solomon | 294/64.1 |
| 2,247,780 | 7/1941 | Klammt | 52/749.1 X |
| 3,240,525 | 3/1966 | Wood | 294/64.1 |
| 4,583,343 | 4/1986 | Camp | 294/64.1 X |
| 4,753,426 | 6/1988 | Varkala | 269/43 X |
| 4,998,711 | 3/1991 | Borg | 269/21 |
| 5,135,207 | 8/1992 | Bleaney . | |
| 5,184,858 | 2/1993 | Arai | 294/64.1 |
| 5,190,266 | 3/1993 | Barrera . | |
| 5,291,719 | 3/1994 | Buster | 269/904 X |

FOREIGN PATENT DOCUMENTS

4304992 A1 9/1993 Germany .

*Primary Examiner*—Carl D. Friedman
*Assistant Examiner*—Laura A. Callo
*Attorney, Agent, or Firm*—Klarquist Sparkman Campbell Leigh & Whinston, LLP

[57] ABSTRACT

A floor installation clamp comprising a clamp used for joining floorboards. The clamp includes a tension member with a first end and a second end. The tension member is connectable to opposing counterstays. One or both counterstays of the clamp may comprise suction devices removably attachable floorboard surfaces. Alternatively, the opposing counterstay may comprise an end piece that is removably attachable to a floorboard edge.

20 Claims, 3 Drawing Sheets

FLOOR INSTALLATION CLAMP

FIELD OF THE INVENTION

The present invention relates to a clamp for installing flooring, and more particularly to a clamp for joining floorboards.

BACKGROUND OF THE INVENTION

Floorboards provided with tongue and groove edges, or like mating edges, can be used to assemble a durable, high quality floor in a convenient and relatively simple manner. Tongue and groove floorboards generally fit together to form a joint in which a projecting rib on the edge of one board fits into the groove on the edge of another board. This type of interlocking joint aids in aligning the floorboards during assembly and also produces a strong, reliable union between the boards.

Floorboards are generally assembled by gluing the floorboards together at the tongue and groove joint. It is desirable to press the joints together firmly during gluing so that the seal between the floorboards is tight, so as to resist moisture penetration. A tightly sealed joint between adjacent floorboards also improves the appearance of the finished floor in that the joints become nearly invisible. Additionally, tightly sealed floorboard joints can increase the useful wear-life of the floor.

Providing tightly sealed joints between floorboards is typically done by utilizing an intermediate tapping block and hammer, knocking each floorboard into position as it is laid. A disadvantage with this procedure is that the risk of damaging the tongue and groove, or other mating surface, is great. This type of damage may cause unsightly marks or dents at the floorboard joints, reducing the flooring moisture resistance and making further assembly of floorboards difficult. Additionally, utilization of a tapping block and hammer to seal floorboard joints requires that at least one edge of the floorboards be exposed.

If the glued seal between adjacent floorboards is not held firmly under pressure as the glue dries and cures, the floorboard joint may not achieve maximum strength. Furthermore, the wood fibers in the floorboards tend to swell due to the moisture of the glue and, if not firmly held in place, small gaps may be left in the floor surface at the floorboard joints, where dirt and moisture are trapped. Moisture trapped in the joints causes the wood fibers in the floorboards to swell even more, potentially raising the surface layer of the boards closest to the joints. The edges of the floorboards are then left exposed to abnormal wear that shortens the useful life of the floor.

SUMMARY OF THE INVENTION

The present invention provides a clamp for applying pressure to adjacent floorboards as the floor is installed. The clamp is used after application of glue between the floorboard joints to press adjacent floorboards together tightly and keep the joint under pressure until the glue has set. The clamp of the present invention thereby assists in installing a floor having increased moisture resistance, a long useful life, and an improved appearance.

The clamp of the present invention has a tension member with opposing ends. The opposing ends are adapted to attach to counterstays that are releasably anchored to a floorboard. A counterstay may be a suction device that attaches to the surface of a floorboard. A suction device counterstay may further include a suction cup, a pump connected to the suction cup, and means for coupling the suction device to an end of the tension member. Alternatively, a counterstays may be an edge end piece that attaches to the mating surface of the edge of the floorboard. Other types of counterstays may also be used to anchor the clamp to a floorboard.

When using the clamp of the present invention, floorboards having edges with mating surfaces, for example groove and tongue edges, are positioned on an underlying surface. After application of glue along the mating surfaces of adjacent floorboards, the clamp is installed to provide pressure on the joints.

Depending upon the type of counterstays being used with the clamp, installation of the clamp is accomplished by positioning each counterstay in engagement with either a floorboard surface or mating edge of the floorboard. A counterstay comprising a suction device is positioned on the upper surface of a floorboard. A counterstay comprising an edge end piece that matches with the mating edge of a floorboard, is engaged with the edge of the floorboard. The tension member, connected to the counterstays by means such as brackets and catches on each end, is then tightened. Tightening the tension member urges together and tightly maintains the floorboards spanned by the clamp. In this manner, the present invention provides a simple assembly procedure that results in improved joint tightness and reduced possibility of floorboard damage.

An embodiment of the present invention comprising a clamp having a tension member with at least one counterstay comprising a suction device is especially useful for installing floorboards when one or more edges of the floorboards are not exposed. The clamp of the present invention may span numerous adjacent floorboards, providing constant pressure to all the joints therebetween. Such clamps are quickly and easily positioned providing ease and speed in installation of such flooring.

DESCRIPTION OF THE ILLUSTRATED EMBODIMENT

Figure 1:
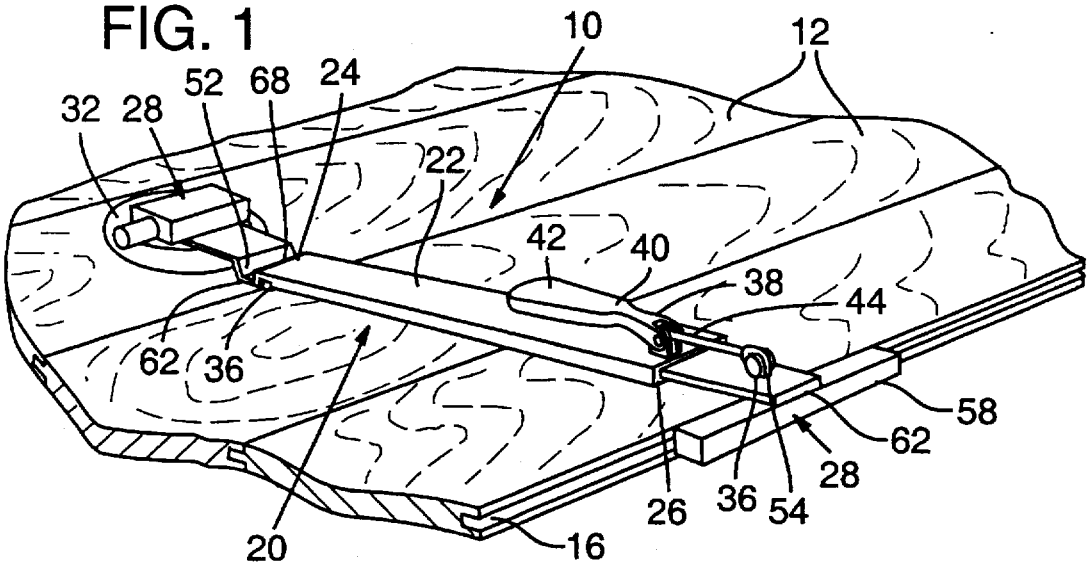
FIG. 1 shows one embodiment of a floor installation clamp according to the present invention.

FIG. 1 shows a clamp 10 in accordance with a preferred embodiment of the present invention. The illustrated clamp is ideally suited for installing floorboards 12 which are provided with tongue and groove, or equivalent mating edges 16. The clamp of the present invention may be used with any of a variety of floorboards.

The embodiment of the clamp 10 illustrated in FIG. 1 has a tension member 22 having a first end 24, a second end 26, and two counterstays 28 that are removably attachable to the floorboards. Both the first and second ends of the tension member 22 are configured to allow quick connection with the counterstays 28.

The counterstays may comprise a suction device 30 removably attached to the surface of the floorboard. Alternatively, the counterstay 28 may comprise an edge end piece 58 that is removably attached to the mating surface on the edge of a floorboard. In the embodiment in FIG. 1, the first end 24 is connected to a counterstay comprising a suction device 30 and the second end is connected to a counterstay comprising an edge end piece 58. In the illustrated configuration, the tension member 22 spans several floorboard joints. Actuation of the tension member 22 serves to urge these joints tightly together so as to create a strong, durable floor.

One of the counterstays 28 of FIG. 1 includes a suction device 30. The illustrated suction device 30 (seen best in FIGS. 3–5) has a suction cup 32 and a pump 34 which can be actuated to evacuate the suction cup 32 and thereby anchor the suction device to the floor. A coupling member 62 extends from the suction device 30 to engage a coupling device 36 on either the first end 24 or the second end 26 of the tension member 22.

The tension member of FIG. 1 has a tension part 38 with an eccentric lock 40. The eccentric lock 40 preferably comprises a ratchet 42 that pivots about a shaft 44, the shaft being positioned on tension part 38 (FIG. 1). Clamping is executed by a simple hand movement that presses the ratchet 42 in a direction toward the first end 24 of the clamp 10. Such a quick set for the tension member 22 minimizes the risk that the glue will set before tension is applied to the floorboards 12.

Figure 2:
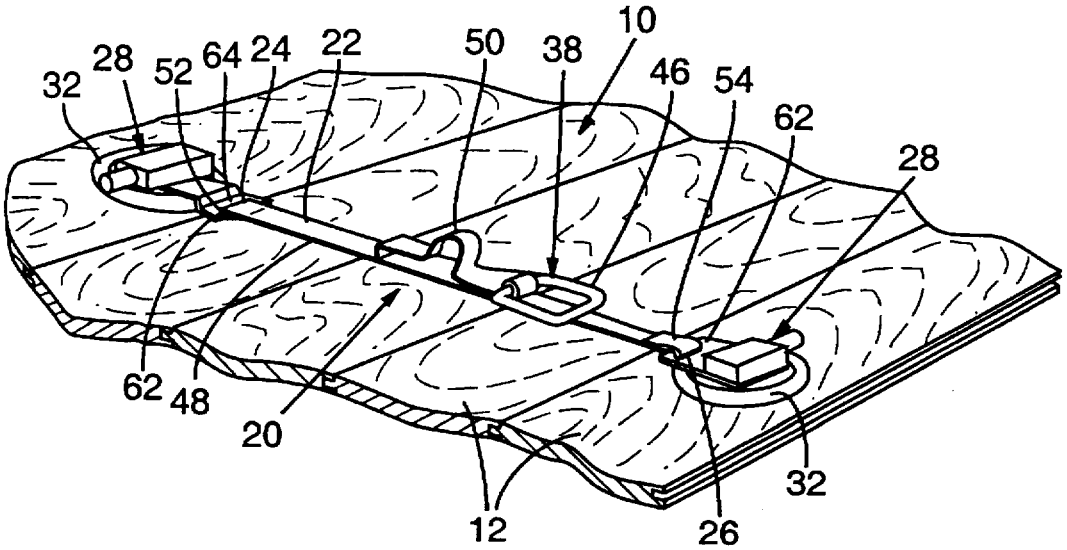
FIG. 2 shows another embodiment of the floor installation clamp according to the present invention.

An alternative embodiment of the tension member 22 is illustrated in FIG. 2. In this embodiment, both the first end 24 and the second end 26 of the tension member are connected to counterstays 28. The tension member 22 has a tension part 38, with a strap 48, a spanner 46 attached to the strap 48, and a back stop 50 connected to the spanner. The strap 48 preferably comprises a slightly resilient material, such as nylon, in the form of a long, narrow strip. In the embodiment of FIG. 2, the length of the strap 48 may be adjusted to allow the tension part 38 to span a range of about 0.1 to about 10 meters.

Figure 6:
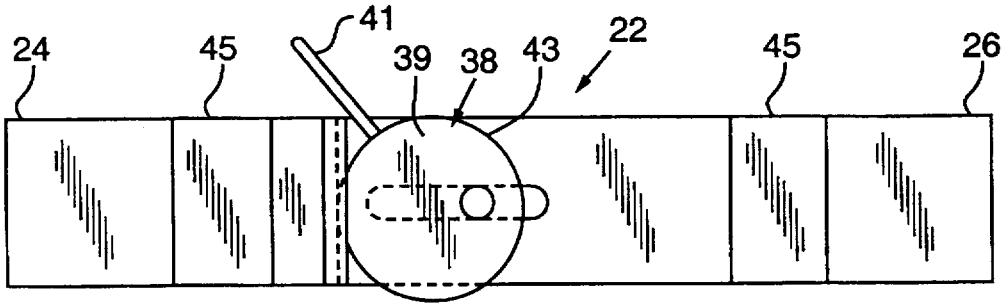
FIG. 6 is a plan view showing an alternative embodiment of a tension member of the present invention.
Figure 7:
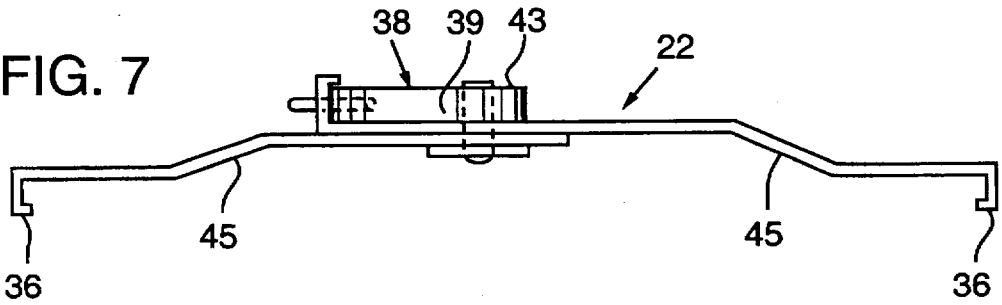
FIG. 7 is a side view showing the tension member illustrated in FIG. 6.

Another embodiment of the tension member 22 is illustrated in FIGS. 6 and 7. This embodiment includes a tension part 38 comprising an off-center lock 39. Clamping is executed by a simple hand movement that presses a handle 41 of a cam 43 in a direction toward the first end 24 of the clamp 10. In moving the handle 41 and cam 43 in a plane substantially horizontal with the floorboards 12, spring tension is created by the folds 45 in the tension member 22.

The first end 24 and second end 26 of tension part 38 of the embodiments illustrated in FIGS. 1, 2, 6, and 7, are provided with first coupling members 36, to which second coupling members 62 of the counterstays 28 are connectable. The first and second coupling members 36, 62 may take a variety of forms, such as brackets and catches. The coupling members should be easily and quickly connectable to one another and, preferably, comprised of a rigid, light weight material, such as plastic or aluminum.

The coupling members of the tension member 22 may also be formed such that a number of tension members can be coupled together in series, so that the ultimate span of the floor installation clamp 10 can be extended as desired.

Figure 3:
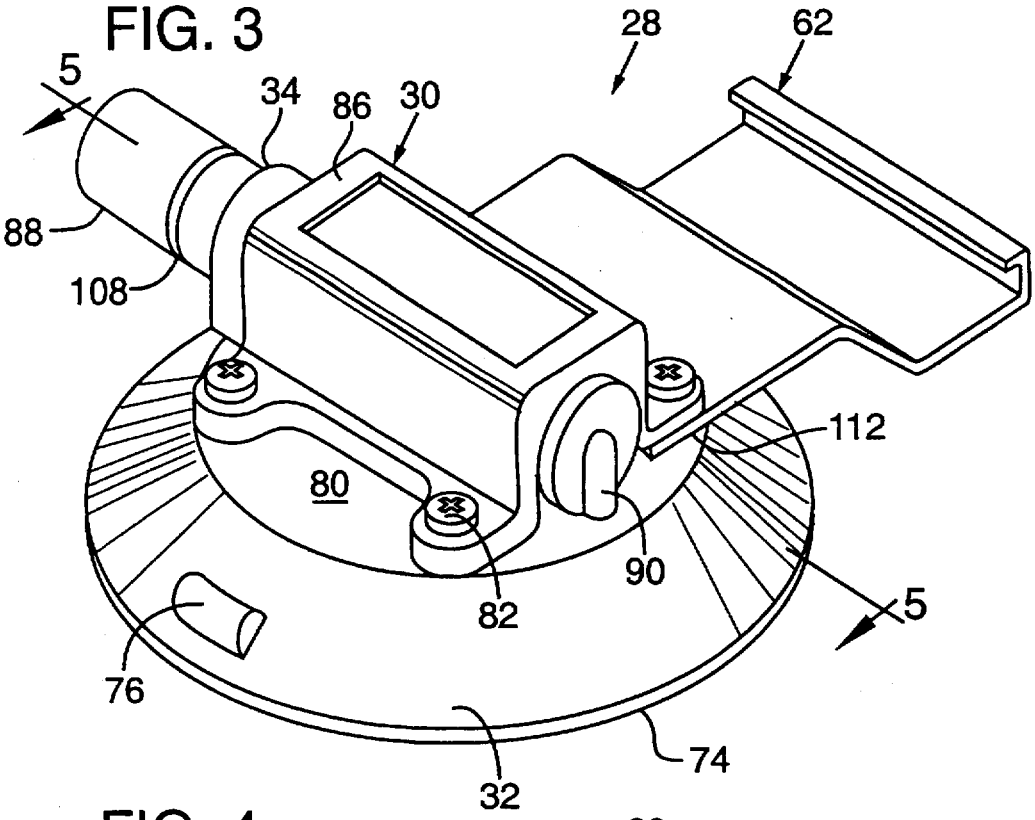
FIG. 3 shows an embodiment of a suction device counterstay component of a floor installation clamp of the present invention.

FIGS. 1 and 2 illustrate an embodiment of the floor installation clamp 10 wherein at least one of the counterstays 28 comprises a suction device 30 best seen in FIG. 3. The suction device 30 includes a suction cup 32 to which is connected a pump 34 and the coupling member 62 described above.

The suction cup 32 may comprise any sufficiently compliant material such that a substantially air tight seal is formed between a rim 74 of the suction cup 32 and the floorboard surface. For laminated floorboards the suction cup 32 may comprise a soft black rubber, such as neoprene. For non-laminated floorboards the suction cup 32 may comprise a softer rubber-type material, as non-laminated floors do not typically have a smooth surface, making the creation of a substantially air tight seal between the floorboard surface and the suction cup 32 more difficult to obtain. The diameter of the suction cups may vary in size depending upon the width of the floorboards being installed. The suction cup diameter should not be larger than the width of the floorboard as the joints between floorboards make it difficult to anchor the suction cup.

In the illustrated embodiment the suction cup 32 further comprises a nib 76 on the outer surface 78 of the suction cup. The nib 76 is shaped and sized to allow an operator to press or pull on the nib and thereby break any vacuum seal existing between the suction cup 32 and the floorboard surface. Once the vacuum seal is broken, the counterstay 28 may be removed.

In the embodiment of FIG. 3, the top portion of suction cup 32 further includes a substantially circular plate 80 molded into the rubber material of the suction cup. The plate 80 may include threaded apertures (not shown) for receiving threaded fasteners 82 to connect the pump 34 to the suction cup 32. Alternatively, plate 80 may include nuts molded therein, or molded into suction cup 32, for receiving fasteners 82. The plate may be plastic, metal or any other suitable material.

The illustrated suction device 30 further includes a hand actuated pump 34 for removing air from the suction cup 32 to form a substantially air tight seal between the rim 74 of the suction cup and the floorboard surface. The pump 34 may be attached to the plate 80 via fasteners 82 or fastened to the plate by gluing or using similar attachment mechanisms.

Figure 5:
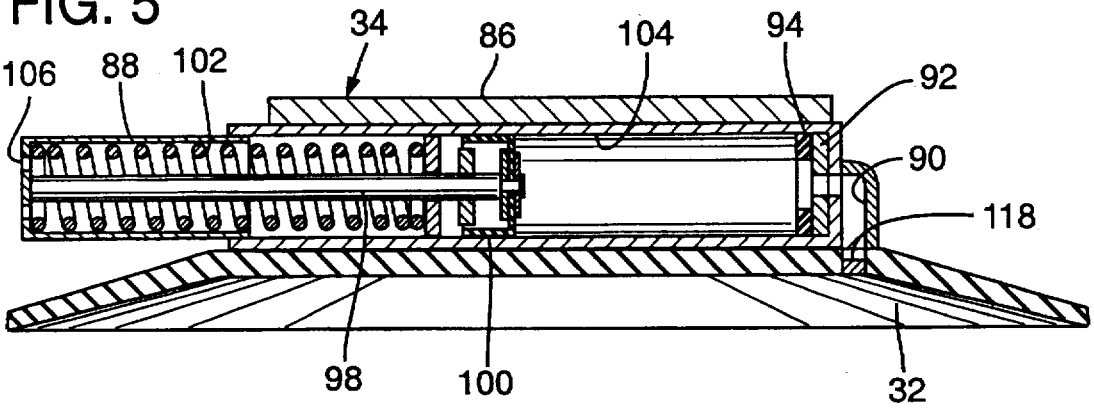
FIG. 5 is a cross-section taken along line 5—5 of FIG. 3.

As best seen in FIG. 5, the illustrated pump 34 comprises a pump housing 86, a plunger 88, and an air tube 90. The air tube 90 is in fluid communication with the suction cup 32 via an opening in the suction cup (not shown) and is also in fluid communication with the interior 104 of the pump housing 86. The opening from the air tube 90 into the suction cup 32 may be covered with a piece of felt-type material 118 to prevent particulates from entering the pump 34. The illustrated pump 34 further comprises a flapper valve 92 positioned near or in the air tube 90. The flapper valve 92 is positioned such that air drawn out of the suction cup 32 may escape the pump 34, but air may not enter the suction cup therethrough. The valve 92 may include a neoprene, nylon, or similar type material lock washer 94 to hold the valve in place. The plunger 88 further includes a plunger shaft 98 having a sealing collar 100 connected thereto which creates a seal against the interior 104 of the pump housing 86. The plunger 88 is biased to the outward position by a helical spring 102.

The pump 34 can be operated to remove air from the suction cup 32 by using a thumb or hand to repeatedly press the plunger 88 inward. Air is removed from the suction cup 32 through valve 92 and vented from the pump 34 through a vent 106.

Figure 4:
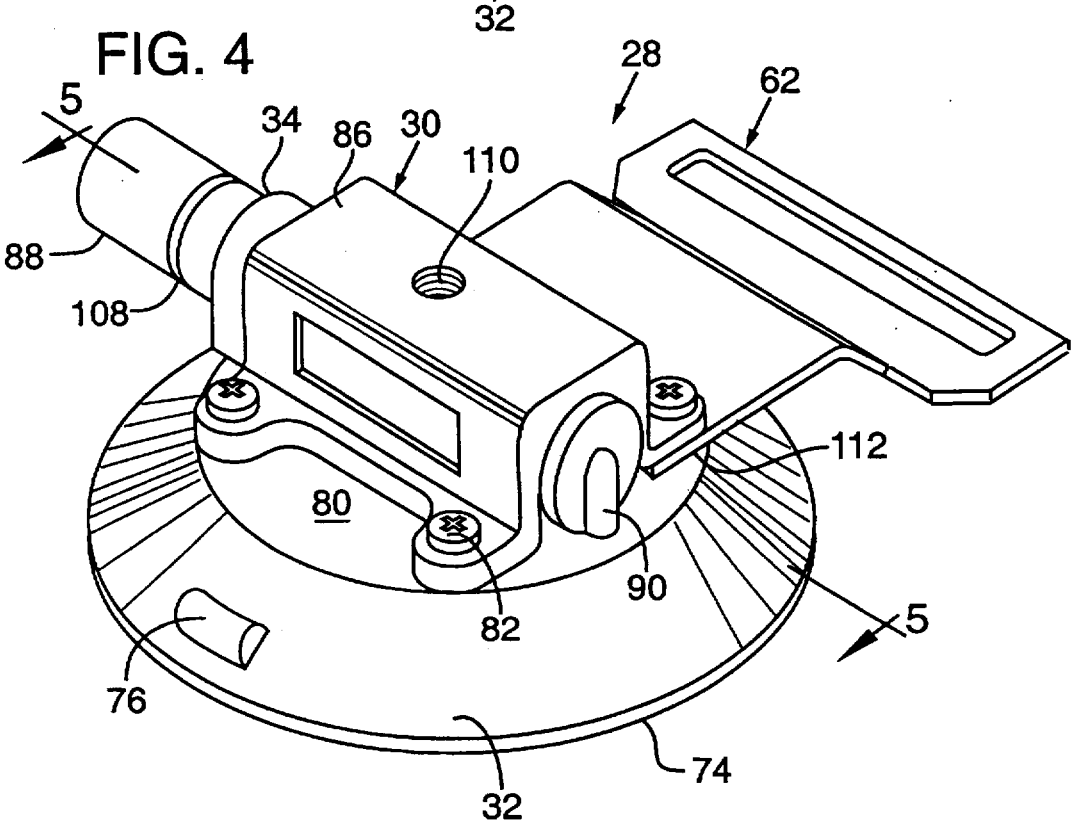
FIG. 4 shows another embodiment of a suction device counterstay component of a floor installation clamp of the present invention.

The plunger 88 may include a vacuum indicator stripe 108 (shown in FIGS. 3 and 4). When a vacuum is created in the suction cup 32, the stripe 108 is hidden from view by the pump housing 86. As the vacuum in the suction cup diminishes, the plunger 88 emerges from the pump housing 86. When the plunger 88 emerges from the pump housing 86 an amount such that the stripe 108 is visible, the vacuum seal within the suction cup 32 is no longer sufficient. The operator can then pump the plunger 88 to reestablish a sufficient vacuum within the suction cup 32.

The pump housing 86 is preferably made of cast aluminum, extruded aluminum, ABS plastic, or a shatter-proof plastic, such as "LEXAN," available from 3M Corporation of Minneapolis, Minn. In the embodiment of the present invention illustrated in FIG. 4, the pump housing 86 includes an aperture 110 for attaching other tools thereto, such as a straight edge or circular form for making specialized cuts in the floorboards 12. The aperture 110 is preferably threaded.

As shown in FIGS. 3 and 4, the coupling member 62 of the counterstay 28 may be attached to the suction device 30 by connection of a flat end 112 of the coupling member between the pump housing 86 and the plate 80. To accommodate the coupling member 62, one side of the pump housing 86 is shorter than the other.

As discussed above, the counterstays 28 at either or both ends of the clamp 10 may comprise a suction device 30 that anchors to the floorboard surface or an edge end piece that anchors to the mating surface of a floorboard edge. The embodiment of the clamp illustrated in FIG. 1 includes one counterstay 28 comprising an edge end piece 58 and the other counterstay 28 comprising a suction device 30. When the counterstay comprising the end edge piece is attached to a floorboard edge, it stays in this position while the counterstay comprising the suction device is gradually moved as further rows of floorboards 12 are added.

A device comprising two suction device counterstays 28 requires no open floorboard edges. The embodiment of the clamp illustrated in FIG. 2 has both counterstays 28 comprising suction devices 30.

Operation of the device is described in terms of the embodiment illustrated in FIG. 1. All embodiments operate in a substantially similar manner unless otherwise indicated.

When utilizing the clamp 10 of the present invention, glue is first applied to the edges of the floorboards 12 that are then joined row by row. The floorboards 12 in a newly laid row are firmly pressed towards the previously laid row before the glue has set. This is performed by first placing the counterstay 28 of the clamp 10 against the edge of the floorboard 12. The tension part 38 of the clamp is, at this point, in a non-clamped position. Tension part 38 is directed substantially perpendicular to the joint between adjacent floorboards 12. The second counterstay, comprising a suction device 30, is then placed against the floor surface on an opposing floorboard. Air is removed from the suction cup 32 by means of the pump 34. In this way, the suction device 30 becomes fixed on the floor. The tension part 38 is then clamped, so that the floorboards 12 are firmly pressed together.

The glue is allowed to set whereupon the tension part 38 is loosened and the clamp 10 is removed. Further rows can then be added in the same way until the floor is finished. Normally two or more clamps are used simultaneously with a suitable distance therebetween.

This detailed description is set forth only for purposes of illustrating examples of the present invention and should not be considered to limit the scope thereof, in any way. Clearly, numerous additions, substitutions, and other modifications can be made to the invention without departing from the scope or spirit of the invention which is defined in the appended claims and equivalents thereof.

I claim:

1. A clamp for installing floors, the clamp comprising:

a first counterstay having a suction device and a coupling member connected at a first end to the suction device and extending therefrom to a second end, the second end of the coupling member forming a first reverse bend;

a second counterstay;

a first tension member having a first end forming a connector that is mateable with the first reverse bend of the coupling member so as to be quickly and releasably connected to the first counterstay, and a second end quickly and releasably connected to the second counterstay; and a tension part connected to the first tension member at a location between the first counterstay and the second counterstay, the tension part operable to urge the first and second counterstays toward one another.

2. The clamp of claim 1 wherein the connector formed by the first end of the first tension member comprising a second reverse bend that is mateable with the first reverse bend of the coupling member.

3. The clamp of claim 1 wherein the tension part comprises an eccentric lock operable to urge the first and second counterstays toward one another.

4. The clamp of claim 1 wherein the second counterstay includes a coupling member connectable to grooved and tongued edges of floorboards.

5. The clamp of claim 1 wherein the suction device comprises a suction cup having an interior portion and an exterior portion, and a pump, the suction cup being operable to create a substantially air-tight seal between the suction cup and a floor surface.

6. The clamp of claim 5 wherein the pump further includes:

a plunger;

a pump housing having an interior and substantially surrounding the plunger;

a biasing member urging the plunger in a direction away from the pump housing; and an air tube in fluid communication with the interior of the pump housing and in fluid communication with the interior portion of the suction cup.

7. The clamp of claim 6 wherein the second counterstay has a suction device.

8. The clamp of claim 5 wherein operation of the pump removes air from the suction cup.

9. The clamp of claim 1 wherein the first tension member comprises a strap and the tension part comprises a spanner attached to the strap, the spanner and strap operable to urge the first and second counterstays toward one another.

10. The clamp of claim 1 further including a second tension member releasably connected in series with the first tension member.

11. A clamp for installing floors comprising:

a first suction cup having an interior portion and an exterior portion, wherein the first suction cup is releasably connectable to a surface of a floor;

a coupling member having a first end and a second end, the first end of the coupling member connected to the suction cup, the second end of the coupling member forming a first reverse bend;

a pump connected to the suction cup, the pump including:

a plunger;

a pump housing having an interior and substantially surrounding the plunger;

a biasing member adjacent to the plunger, the biasing member urging the plunger in a direction away from the pump housing;

an air tube in fluid communication with the interior of the pump housing and in fluid communication with the interior portion of the suction cup; and a tension member having a first end and a second end, the first end of the tension member forming a second reverse bend that is mateable with the first reverse bend of the coupling member so as to be quickly and releasably connectable to the second end of the coupling member, the second end of the tension member being quickly and releasably connectable to the floor.

12. The clamp of claim 11 further including a second suction cup connected to the second end of the tension member.

13. The clamp of claim 11 wherein the second end of the tension member includes a coupling member connectable to grooved and tongued edges of floorboards.

14. The clamp of claim 13 wherein the first suction cup includes a projection positioned on the exterior portion of the first suction cup, the projection operable to break a substantially air-tight seal between the first suction cup and the floor surface whenever a sufficient amount of force is applied to the projection.

15. A method for joining floorboards comprising the steps of:

applying glue to joints between adjacent floorboards;

providing a clamp having a first end and a second end, the second end comprising a suction device and a coupling member connected at a first end to the suction device and extending from the suction to form a first reverse bend;

disposing a tension member between the first end and second end of the clamp, wherein a second end of the tension member forms a connector that is mateable with the first reverse bend so as to be quickly and releasably connectable thereto and is operable to create tension between the first end and the second end of the clamp;

mounting the first end of the clamp to a first floorboard;

releasably connecting the first end of the tension member to the first end of the clamp and the second end of the tension member to the reverse bend of the second end of the clamp;

mounting the suction device of the second end of the clamp to a surface of a second floorboard;

creating a substantially air-tight seal between the suction device and the surface of the second floorboard;

tightening the tension member to urge the first floorboard and the second floorboard toward one another until the glue has set; and removing the clamp from the first and second floorboards.

16. The method of claim 15 wherein the mounting of the suction device of the second end of the clamp further comprises the steps of:

providing a suction cup;

providing a pump connected to the suction cup; and removing air from the suction cup by actuating the pump to create a substantially air-tight seal between the suction cup and the surface of the second floorboard.

17. The method of claim 16 wherein the step of removing the clamp further includes the steps of:

providing a projection on a portion of the suction cup; and applying force on the projection thereby breaking the substantially air-tight seal between the suction cup and the surface of the second floorboard.

18. The method of claim 15 wherein the step of mounting of the first end of the clamp further comprises the step of providing an edge end piece that mates securely to an edge of the first floorboard.

19. The method of claim 15 wherein the step of mounting the first end of the clamp further comprises the steps of:

providing a suction cup on the first end of the clamp;

providing a pump connected to the suction cup; and removing air from the suction cup by actuating the pump to create a substantially air-tight seal between the suction cup of the first end of the clamp and a surface of the first floorboard.

20. The method of claim 15, wherein releasably connecting the second end of the tension member to the first reverse bend of the clamp includes connecting a second reverse bend formed by the second end of the tension member to the first reverse bend so as to create a releasable connection therebetween.

* * * * *